US006364681B1

(12) United States Patent
Watanabe

(10) Patent No.: US 6,364,681 B1
(45) Date of Patent: Apr. 2, 2002

(54) CONNECTOR ASSEMBLY AND METHOD OF MOUNTING SAME

(75) Inventor: Hiroshi Watanabe, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/444,578

(22) Filed: Nov. 19, 1999

(30) Foreign Application Priority Data

Dec. 14, 1998 (JP) ..... 10-354890

(51) Int. Cl.[7] ..... H01R 4/50
(52) U.S. Cl. ..... 439/335; 439/533
(58) Field of Search ..... 439/332, 333, 439/334, 335, 336, 557, 369, 533, 372

(56) References Cited

U.S. PATENT DOCUMENTS 1,021,195 A * 3/1912 Knauff ..... 439/335
1,185,645 A * 6/1916 Faw ..... 439/336
1,604,836 A * 10/1926 Moldenhauer ..... 439/336
2,947,966 A * 8/1960 Francis et al. ..... 439/335
4,359,256 A * 11/1982 Gallusser et al. ..... 439/335
4,678,260 A * 7/1987 Gallusser et al. ..... 439/607
5,800,183 A * 9/1998 Paul et al. ..... 439/557

* cited by examiner

*Primary Examiner*—Hien Vu
(74) *Attorney, Agent, or Firm*—Sughrue Mion, PLLC

(57) ABSTRACT

A connector assembly includes a generally cylindrical lock frame for being fixed to a through hole in a vehicle body panel, a first connector fitted in one open end of the lock frame, and a second connector fitted in the other open end of the lock frame. A pair of first cam grooves are formed in a cylindrical portion of the lock frame, and extend spirally along an axis of the lock frame in continuous relation to the one open end thereof, and a pair of second cam grooves are formed in the cylindrical portion, and extend spirally in the same direction as the direction of helically-extending of the first cam grooves in continuous relation to the other open end of the cylindrical portion, and the pair of first cam grooves as well as the pair of second cam grooves are disposed at an equal interval around the axis of the connector assembly. The first connector has bosses for engagement in the respective cam grooves, and the second connector has bosses for engagement in the respective cam grooves.

14 Claims, 5 Drawing Sheets

CONNECTOR ASSEMBLY AND METHOD OF MOUNTING SAME

BACKGROUND OF INVENTION

1. Field of the Invention

This invention relates to a connector assembly including a pair of connectors connected together through a through hole formed through a vehicle body panel (fixing portion) or the like, and the invention also relates to an improved method of mounting the connector assembly.

2. Related art

A connector assembly is used for connecting wire harnesses, used in an automobile, together through a through hole formed through a vehicle body panel, a door panel or the like, and from the viewpoint of safety, it is necessary that a pair of connectors (which form the connector assembly), secured respectively to ends of the wire harnesses, should be completely fitted together.

However, a fitting force, required for fitting the two connector together, increases with the increase of the number of wires (signal wires, power wires or the like) of the wire harnesses, so that the possibility of a half-fitted condition becomes larger. Particularly in the type of connector assembly requiring dustproof and waterproof effects, a seal member, made of an elastic material, is provided at a fitting portion, and a reaction force is produced as a result of compression of this seal member, and therefore an incompletely-fitted condition of the connector assembly is liable to occur, and besides the efficiency of the mounting operation is not good.

Therefore, in a connector assembly-mounting method, disclosed for example in Japanese Patent Unexamined Publication No. 9-17508, a strip-like fitting-detection pin is provisionally inserted into a detection insertion hole, formed in a side wall of a first housing, in such a manner that this detection pin passes generally through an axis of the first housing, and in this condition a second housing is inserted into a fitting hole in the first housing.

Then, the fitting-detection pin is completely inserted into the detection insertion hole in the first housing, and guide ribs, formed on opposed inner surfaces of a detection pin recess formed in the second housing, are engaged with a cam groove (having a slanting surface) formed in the fitting-detection pin. Then, the second housing is pushed into the fitting hole in the first housing through the engagement between the cam groove and the guide ribs.

As a result, even if the number of wires to be connected to the two housings increases, the housings can be fitted together satisfactorily with a low operating force, and a half-fitted condition is eliminated, and the wires can be positively connected together.

If the two housings are not completely fitted together, the fitting-detection pin can not be completely inserted into the detection insertion hole in the first housing, and can not be pushed thereinto, and therefore by observing the fitting-detection pin, a half-fitted condition can be detected quite easily.

In such a half-fitted condition, the rear end portion of the fitting-detection pin projects from the side wall of the first housing, and in this condition, even if trying to mount the first housing in a panel hole in a panel, the first housing can be fixed since the rear end portion of the fitting-detection pin interferes with the edge portion of the panel hole. Therefore, the connector assembly in a half-fitted condition is prevented from being fixed to the panel hole.

However, in the connector assembly-mounting method disclosed in Japanese Patent Unexamined Publication No. 9-17508, when the two housings are to be connected together through the panel hole in the panel, and are to be fixed to this panel hole, the second housing, connected to ends of the wires, is beforehand pulled out of the panel hole in the panel, and the fitting-detection pin is completely inserted into the detection insertion hole, and the first and second housings are fitted together, and thereafter the first and second housing thus fitted together are returned to the panel hole, and are fixed to the panel hole, which leads to a problem that the efficiency of the operation is not good.

Therefore, for example, in the case of effecting the above connector-fitting operation of the connector assembly simultaneously when mounting a door on a vehicle body, it is necessary to effect the passing operation for beforehand pulling the second housing out of the panel hole in the panel, which leads to a problem that the door assembling operation is complicated.

SUMMARY OF INVENTION

It is therefore an object of this invention to solve the above problems, and more specifically to provide a connector assembly and a connector assembly-mounting method, in which two connectors can be fitted together with a lower inserting force, and a half-fitted condition is prevented, and the mounting operation can be effected easily.

The above object of the present invention has been achieved by a connector assembly including:

a generally cylindrical lock frame for being fixed to a is through hole in a fixing portion;

a first cam groove extending spirally along an axis of the lock frame in continuous relation to one open end of the lock frame;

a second cam groove extending spirally in the same direction as a direction of helically-extending of the first cam groove in continuous relation to the other open end of the lock frame;

a first connector which is fitted in the one open end of the lock frame, and has a first engagement projection engaged in the first cam groove; and a second connector which is fitted in the other open end of the lock frame, and has a second engagement projection engaged in the second cam groove; provided in that:

the first engagement projection is engaged in a provisionally-retaining position of the first cam groove, thereby provisionally retaining the first connector at the one open end of the lock frame;

the second connector is inserted into the other open end of the lock frame fixed to the through hole, with the second engagement projection engaged in the second cam groove, so that the second connector is held in a provisionally-fitted condition relative to the first connector disposed in the provisionally-retaining position; and the first and second cam grooves are so formed that when the second connector, while rotated following the second cam groove, is inserted into the lock frame, a force, which displaces the first connector from the provisionally-retaining position to a completely-retaining position while rotating the first connector, following the first cam groove, and also completely fits the first connector relative to the second connector, is exerted through the first and second engagement projections.

The above object of the present invention has been achieved by a method of mounting a connector assembly including a generally cylindrical lock frame for being fixed to a through hole in a fixing portion;

a first cam groove extending spirally along an axis of the lock frame in continuous relation to one open end of the lock frame;

a second cam groove extending spirally in the same direction as a direction of helically-extending of the first cam groove in continuous relation to the other open end of the lock frame;

a first connector which is fitted in the one open end of the lock frame, and has a first engagement projection engaged in the first cam groove; and a second connector which is fitted in the other open end of the lock frame, and has a second engagement projection engaged in the second cam groove; the method being provided by the steps of:

engaging the first engagement projection in a provisionally-retaining position of the first cam groove, thereby provisionally retaining the first connector at the one open end of the lock frame, and subsequently fixing the lock frame to the through hole;

inserting the second connector into the other open end of the lock frame, with the second engagement projection engaged in the second cam groove, so that the second connector is held in a provisionally-fitted condition relative to the first connector disposed in the provisionally-retaining position; and inserting the second connector into the lock frame while rotating the second connector, following the second cam groove, thereby displacing the first connector from the provisionally-retaining position to a completely-retaining position while rotating the first connector, following the first cam groove, so that the first and second connectors are completely fitted together.

In the connector assembly of the above construction and the above mounting method, the first and second connectors are connected together through the through hole in the fixing portion. For fixing the connector assembly to the through hole, the first engagement projection of the first connector, connected to ends of wires, is first engaged in the provisionally-retaining position in the first cam groove in the lock frame, thereby provisionally retaining the first connector at the one open end of the lock frame, and then the lock frame is fixed to the through hole in the fixing portion.

Then, the second connector is inserted into the other open end of the lock frame, with the second engagement projection engaged in the second cam groove in the lock frame, so that the second connector is held in a provisionally-fitted condition relative to the first connector disposed in the provisionally-retaining position.

Then, the second connector is inserted into the lock frame while rotating the second connector, following the second cam groove extending along the axis of the lock frame, so that the first connector rotates together with the second connector to be displaced from the provisionally-retaining position to the completely-retaining position, following the first cam groove.

The first and second cam grooves are so formed that the force to completely fit the first and second connectors together is exerted through the first and second engagement projections at this time, and therefore the operator is required merely to insert the second connector into the lock frame, beforehand fixed to the through hole, while rotating the second connector, and by doing so, the first and second connectors can be fitted together.

The forces to fit the first and second connectors together act respectively on the first and second connectors through the first and second engagement projections engaged respectively in the first and second cam grooves extending spirally along the axis of the lock frame, and therefore an eccentric force hardly acts on the two connectors during the time when the two connectors are fitted together.

Therefore, the two connectors are hardly twisted, and can be fitted together satisfactorily with the low operating force, and the two connectors can be positively connected together.

In the connector assembly of the above construction and the mounting method of mounting this connector assembly, the mutually-fitted condition of the first and second connectors corresponds to the position of rotation of the second connector relative to the lock frame, and therefore in order to completely fit the two connectors together, the second connector must be rotated into a predetermined position relative to the lock frame.

Therefore, by observing the position of rotation of the second connector relative to the lock frame, a half-fitted condition of the first and second connectors can be quite easily detected.

Preferably, at least two pairs of the first and second cam grooves, as well as at least two pairs of the first and second engagement projections, are provided, and the first and second cam grooves, as well as the first and second engagement projections, are disposed at an equal interval around the axis of the connector assembly. With this construction, the two connectors are less liable to be twisted, and the two connectors can be fitted together satisfactorily with the lower operating force.

Preferably, the first and second cam grooves have such configurations that the first and second connectors, held in the completely-fitted condition, can be rotated a predetermined angle relative to the lock frame. With this construction, by rotating the second connector through more than the predetermined angle relative to the lock frame, the two connectors can be completely fitted together regardless of molding errors and dimensional tolerances of the constituent parts.

Preferably, the first cam groove has a retaining projection for retaining the first engagement projection in the provisionally-retaining position. With this construction, the first connector can be easily provisionally retained relative to the lock frame, and the two connectors can be connected together more easily.

DETAILED DESCRIPTION OF PREFERRED EMBODIMENTS

One preferred embodiment of a connector assembly of the present invention, as well as a method of mounting this connector assembly, will now be described in detail with reference to the accompanying drawings.

Figure 1:
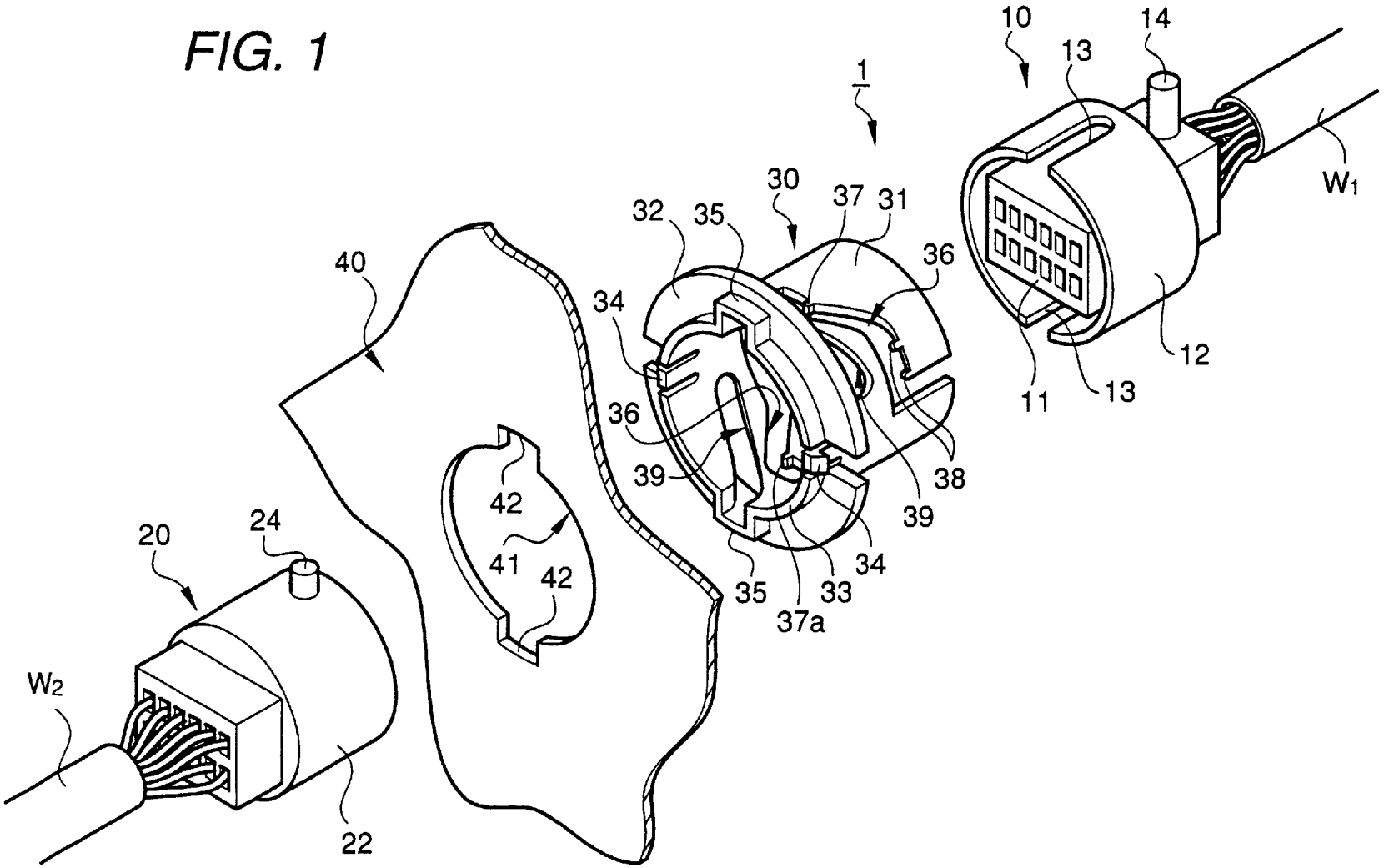
FIG. 1 is an exploded, perspective view of one preferred embodiment of a connector assembly of the present invention.
Figure 2:
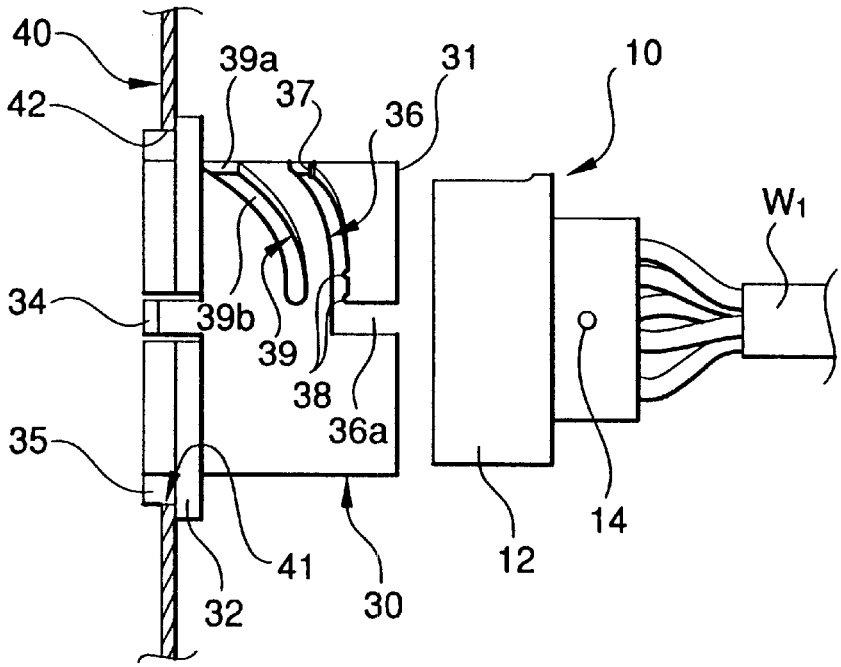
FIG. 2 is a side-elevational views explanatory of a method of assembling the connector assembly of FIG. 1.
Figure 3:
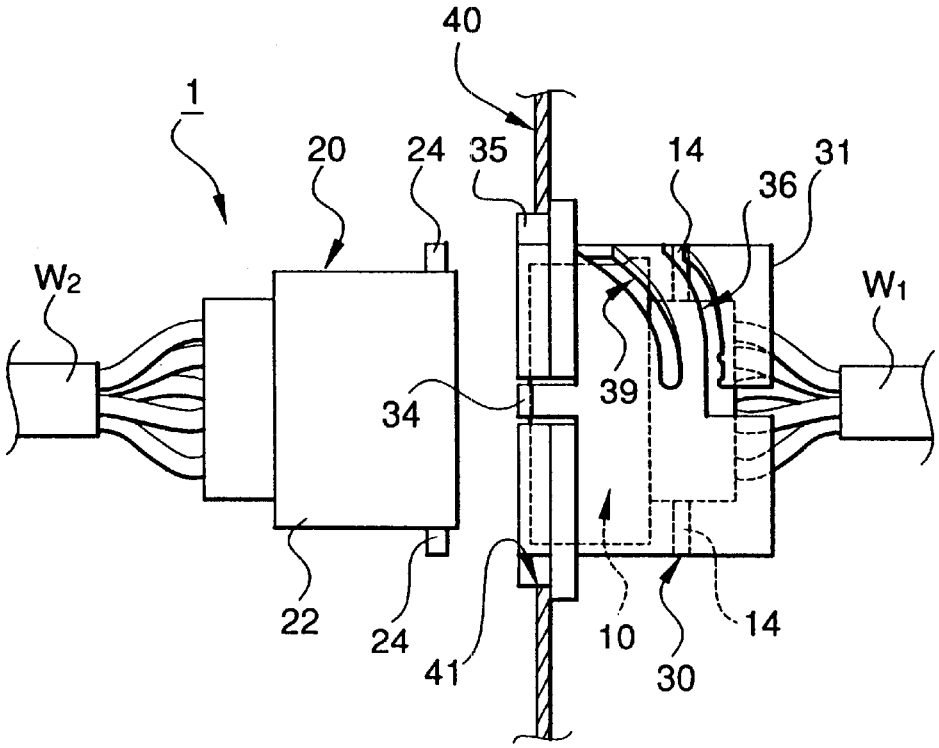
FIG. 3 is a side-elevational views explanatory of the method of assembling the connector assembly of FIG. 1.
Figure 4:
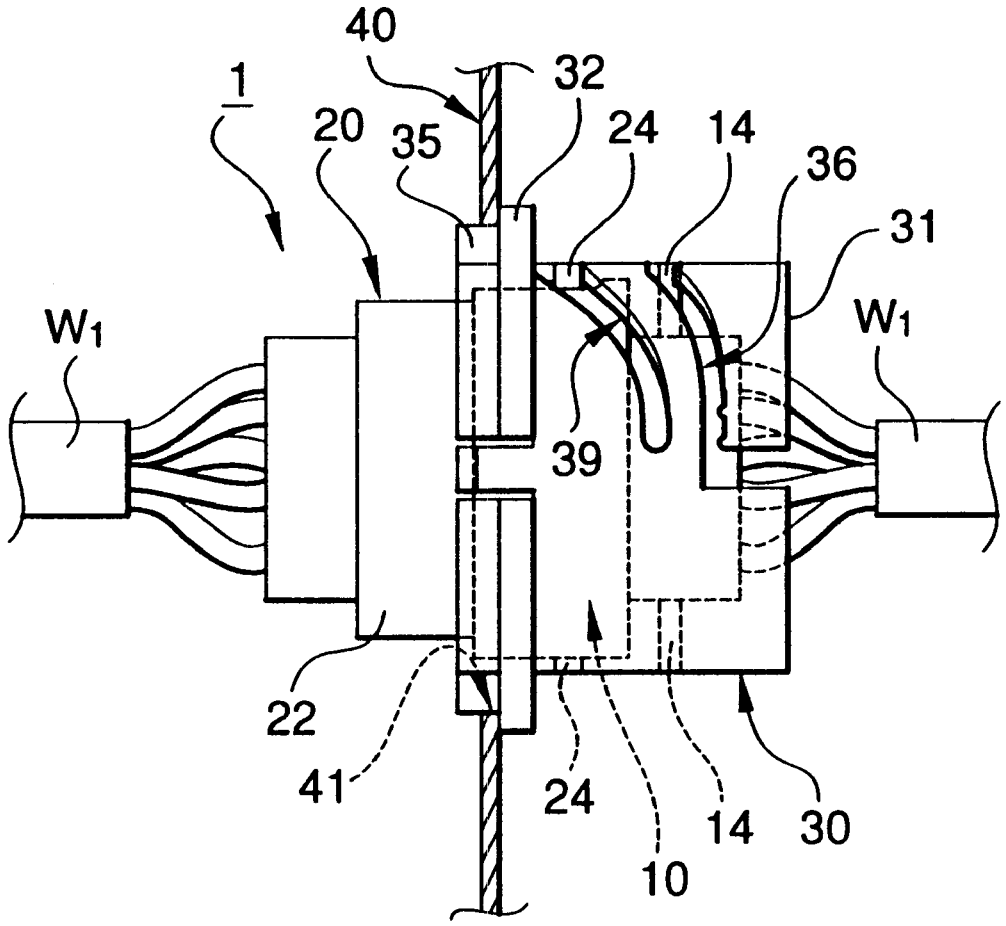
FIG. 4 is a side-elevational views explanatory of the method of assembling the connector assembly of FIG. 1.
Figure 5:
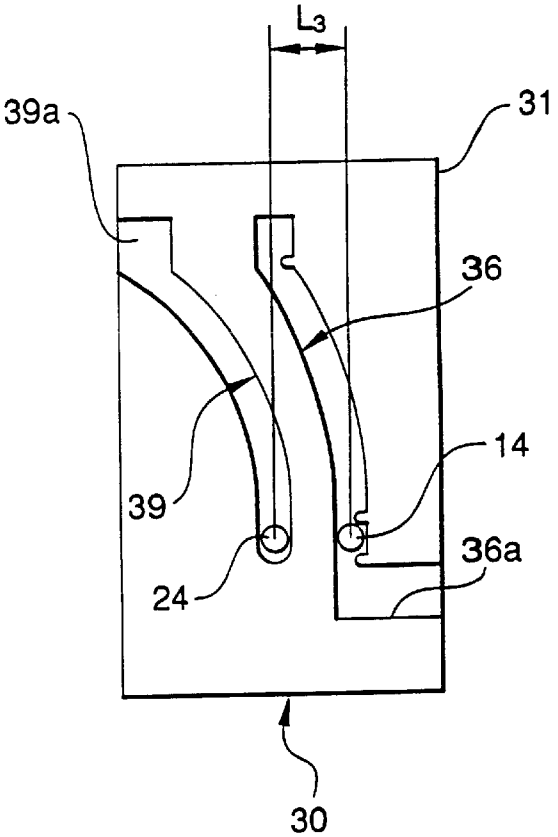
FIGS. 5 (*a*) to (*c*) are developed views showing the relation between cam grooves and engagement projections in the connector assembly of FIG. 1.
Figure 5:
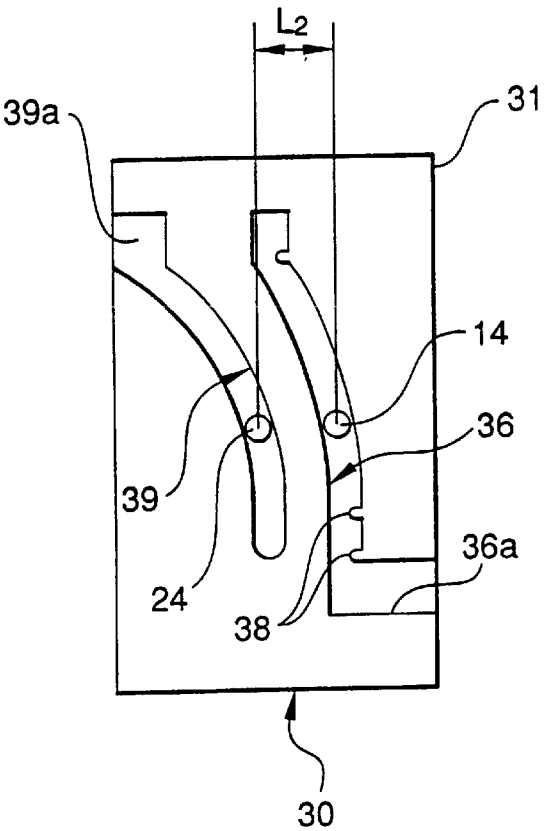
Figure 5:
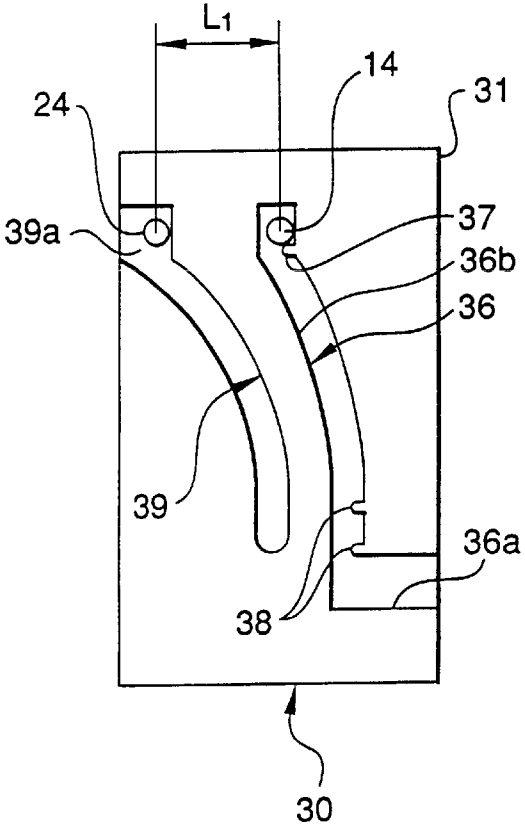
Figure 6:
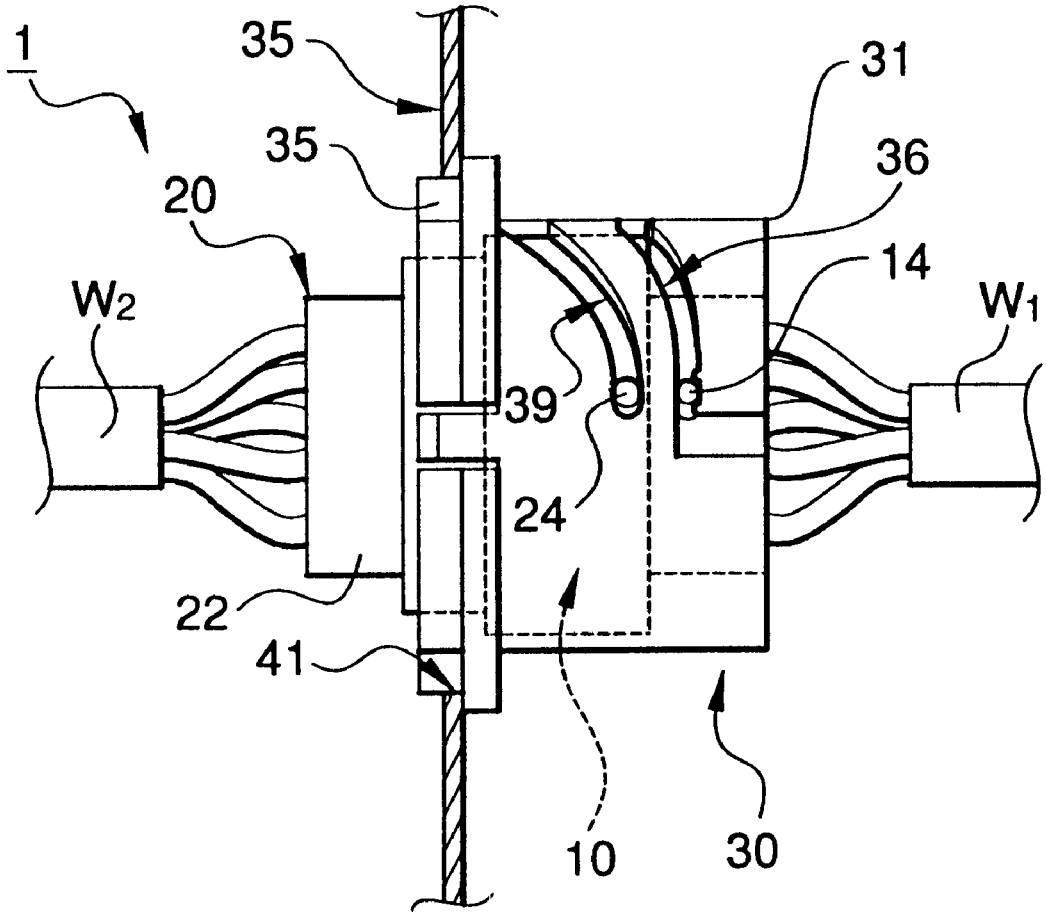
FIG. 6 is a side-elevational view showing a completely-fitted condition of the connector assembly of FIG. 1.

FIG. 1 is an exploded, perspective view of one preferred embodiment of the connector assembly of the invention, FIGS. 2 to 4 are side-elevational views showing the method of assembling the connector assembly of FIG. 1, FIG. 5 is a developed view showing the relation between cam grooves and engagement projections in the connector assembly of FIG. 1, and FIG. 6 is a side-elevational view showing a completely-fitted condition of the connector assembly of FIG. 1.

As shown in FIG. 1, the connector assembly 1 of this embodiment comprises a lock frame 30 of a generally cylindrical shape for fixing to a through hole 41, formed through a vehicle body panel (fixing portion) 40, a first connector 10 for fitting in one open end (right open end in FIG. 1) of the lock frame 30, and a second connector 20 for fitting in the other open end (left open end in FIG. 1) of the lock frame 30.

As shown in FIGS. 1 and 2, the first cam grooves 36 are formed in a cylindrical portion 31 of the lock frame 30, and extend spirally along an axis (centerline) of the lock frame 30 in continuous relation to the one open end (right open end in FIG. 2) thereof, and the second cam grooves 39 are formed in the cylindrical portion 31, and extend spirally in the same direction as the direction of helically-extending of the first cam grooves 36 in continuous relation to the other open end (left open end) of the cylindrical portion 31, and the pair of first cam grooves 36 as well as the pair of second cam grooves 39 are disposed at an equal interval around the axis of the connector assembly 1.

A fitting portion 33 for fitting in the through hole 41 is formed at the other open end of the cylindrical portion 31, and also a flange 32 is formed at this open end portion. A pair of lock arms 34 and 34 for engagement with a peripheral edge of the through hole 41 to serve as withdrawal prevention means are formed on the fitting portion 33, and also a pair of fitting projections 35 and 35 for fitting in notches 42 and 42 in the peripheral edge of the through hole 41 to serve as rotation prevention means are formed on the fitting portion 33. The fitting projections 35 and 35 coincide with the open ends of the second cam grooves 39 and 39, respectively.

As shown in FIG. 2, the first cam groove 36 includes a first introduction portion 36*a* extending from the one open end of the cylindrical portion 31 along the axis of the lock frame 30, and a first guide portion 36*b* extending spirally from the first introduction portion 36*a* along the axis of the lock frame.

The second cam groove 39 includes a second introduction portion 39*a* extending from the other open end of the cylindrical portion 31 along the axis of the lock frame 30, and a second guide portion 39*b* extending spirally from the second introduction portion 39*a* in the same direction as the direction of helically-extending of the first guide portion 36*b*.

The first guide portion 36*b*, extending generally parallel to the second guide portion 39*b*, is formed into such a cam shape that the distance of the first guide portion 36*b* from the second guide portion 39*b* is first decreasing progressively from one end thereof, disposed adjacent to the second introduction portion 39*a*, toward the first introduction portion 36*a*, and then the first guide portion 36*b* becomes parallel to the second guide portion 39*b*.

As shown in FIG. 1, the first connector 10 comprises a male connector portion 11 of a rectangular shape for receiving a plurality of contacts (not shown) connected to one end of a vehicle body-side wire harness $W_1$, a cylindrical hood portion 12 which covers the outer periphery of the male connector portion 11, and can be brought into sliding contact with the inner peripheral surface of the cylindrical portion 31, and a pair of bosses 14 (first engagement projections) extending from a rear end portion of the male connector portion 11 so as to be engaged respectively in the first cam grooves 36 and 36 (see FIG. 3). Notches 13 and 13 for preventing the interference of bosses (second engagement projections) 24 and 24 (described later) are formed in a front end portion of the hood portion 12.

The second connector 20 comprises a female connector portion 22, which receives a plurality of contacts (not shown), connected to one end of an auxiliary equipment-side wire harness $W_2$, and is adapted to fit in the male connector portion 11, and the pair of bosses (second engagement projections) 24 and 24 extending from a front end portion of the female connector portion 22 so as to be engaged respectively in the second cam grooves 39 and 39 (see FIG. 3).

Next, the mounting method of fixing the connector assembly 1 of this embodiment to the through hole 41 in the vehicle body panel 40 will be described.

First, the first connector 10, connected to the one end of the vehicle body-side wire harness $W_1$, is fitted into the cylindrical portion 31 through the one open end of the lock frame 30. At this time, the bosses 14 and 14 are introduced respectively into the first introduction portions 36*a* and 36*a*, and are pushed into engagement with inner ends of these portions 36*a* and 36*a*, respectively, and then the bosses 14 and 14 are moved respectively along the first guide portions 36*b* and 36*b* while rotating the first connector 10 in a clockwise direction, and the bosses 14 and 14 slide respectively past retaining projections 37, formed respectively at inner end portions of the first cam grooves 36 and 36, thereby holding each boss 14 in a provisionally retaining position. Therefore, the first connector 10, having the bosses 14 and 14 held in the respective provisionally-retaining positions by the retaining projections 37 and 37, is provisionally retained relative to the lock frame 30, and will not accidentally rotate out of engagement with the lock frame 30.

Then, when the fitting portion 33 of the lock frame 30 is fitted into the through hole 41 in the vehicle panel 40 as shown in FIG. 3, the fitting projections 35 and 35 are fitted respectively in the notches 42 and 42, and also the lock arms 34 and 34 are engaged with the peripheral edge of the through hole 41, thereby fixing the lock frame 30 to the through hole 41.

After fixing the lock frame 30 to the through hole 41 as shown in FIG. 2, the first connector 10 may be fitted into the cylindrical portion 31 to be provisionally retained thereto.

Then, the second connector 20, connected to the one end of the auxiliary equipment-side wire harness $W_2$, is fitted into the cylindrical portion 31 through the other open end of the lock frame 30. At this time, the bosses 24 and 24 are introduced respectively into the second introduction portions 39*a* and 39*a*, and are pushed into engagement with inner ends of these portions 39*a* and 39*a*, respectively.

Then, as shown in FIGS. 4 and 5(*a*), the female connector portion 22 of the second connector 20, having the bosses 24 and 24 held against the inner ends of the second introduction portions 39*a* and 39*a*, is disposed in a provisionally-fitted condition relative to the male connector portion 11 of the first connector 10 provisionally retained in the provisionally-retaining position of the lock frame 30. In this provisionally-fitted condition, the contacts of the female connector portion 22 are not yet electrically connected respectively to the contacts of the male connector portion 11, but their housings are fitted together to prevent a relative rotation therebetween.

In this condition, when the bosses 24 and 24 are moved respectively along the second guide portions 39*b* and 39*b* toward the inner ends of the cam grooves as shown in FIG. 5(*b*) while rotating the second connector 20 in a clockwise direction, the first connector 10, having the male connector portion 11 held in the provisionally-fitted condition relative to the female connector portion 22, is rotated together with the second connector 20, so that the bosses 14 and 14 are moved or displaced from the respective provisionally-retaining positions to respective completely-retaining positions along the respective first guide portions 36*b* and 36*b*.

The distance between the first and second cam grooves 36 and 39 is decreasing gradually as described above, and the distance between the bosses 14 and 24, moving respectively along the first and second cam grooves 36 and 39 is also decreasing gradually as indicated at $L_1$ (in the provisionally-fitted condition of FIG. 5(*a*)), $L_2$ (in a half-fitted condition of FIG. 5(*b*)) and $L_3$ (in the completely-fitted condition of FIG. 5(*c*)).

Namely, the first and second cam grooves 36 and 39 are so formed that when the bosses 24 and 24 are moved respectively along the second guide portions 39*b* and 39*b* in the lock frame 30 toward the inner ends of the cam grooves while rotating the second connector 20 in the clockwise direction, a force to fit the first connector 10 on the second connector 20 acts on the first connector 10 through the bosses 14 and 24.

Therefore, the operator is required merely to insert the second connector 20 into the lock frame 30, beforehand fixed to the through hole 41, while rotating the second connector 20, and by doing so, the first and second connectors 10 and 20 can be easily fitted together. The forces to fit the first and second connectors 10 and 20 together act respectively on the first and second connectors 10 and 20 through the bosses 14 and 24 engaged respectively in the first and second cam grooves 36 and 39 extending spirally along the axis of the lock frame 30, and therefore an eccentric force hardly acts on the two connectors during the time when the two connectors are fitted together.

Therefore, the first and second connectors 10 and 20 are hardly twisted, and the two connectors can be fitted together with the low operating force, and the two connectors can be positively connected together.

Therefore, for example, in the case of effecting the connector-fitting operation of the connector assembly 1 simultaneously when mounting a door on the vehicle body, the operator is required merely to insert the second connector 20 into the lock frame 30, beforehand fixed to the through hole 41 in the vehicle body panel 40, while rotating the second connector 20, and by doing so, the first and second connectors 10 and 20 can be positively fitted together. Thus, there is no need to effect the passing operation for pulling the first connector 10 out of the through hole 41 as required in the conventional construction, and the door assembling operation is easy.

Each of the bosses 14, moved to the completely-retaining position, is retained in this completely-retaining position by a pair of retaining projections 38 and 38 provided adjacent to the first guide portion 36*a*, and therefore the first and second connectors 10 and 20 will not accidentally rotate, and will not be brought out of fitting engagement with each other.

In the connector assembly 1 of the above embodiment and the mounting method of mounting this connector assembly, the mutually-fitted condition of the first and second connectors 10 and 20 corresponds to the position of rotation of the second connector 20 relative to the lock frame 30, and therefore in order to completely fit the two connectors 10 and 20 together, the second connector 20 must be rotated into a predetermined position relative to the lock frame 30.

Therefore, by observing the position of rotation of the second connector 20 relative to the lock frame 30, a half-fitted condition of the first and second connectors 10 and 20 can be quite easily detected. The rear end portion of the housing of the second connector 20 has a rectangular shape, and therefore the position of rotation of the second connector relative to the lock frame 30 can be easily recognized. However, a mark may be provided on the outer peripheral surface of the female connector portion 22 so that the relative rotation position can be recognized more easily.

In the connector assembly 1 of the above embodiment, the pair of first cam grooves 36 as well as the pair of second cam grooves 39, formed in the lock frame 30, are disposed at an equal interval around the axis of the connector assembly 1, and also the bosses 14, formed on the first connector 10, as well as the bosses 24 formed on the second connector 20, are disposed at an equal interval around the axis of the connector assembly 1.

Therefore, when fitting the first and second connectors 10 and 20 together while rotating the second connector 20, the forces to fit the first and second connectors 10 and 20 together act respectively on the first and second connectors 10 and 20 uniformly around the axis (serving as the axis of rotation) of the connector assembly 1 through the bosses 14 and 24 engaged respectively in the first and second cam grooves 36 and 39.

Therefore, the two connectors 10 and 20 are less liable to be twisted, and the connectors can be fitted together satisfactorily with the lower operating force. In the above embodiment, although two pairs of first and second cam grooves 36 and 39 and two pairs of bosses 14 and 24 are disposed around the axis of the connector assembly 1, three or more pairs may be provided.

In the connector assembly 1 of the above embodiment, the first and second cam grooves 36 and 39 are parallel to each other immediately before the completely-retaining position so that the first and second connectors 10 and 20 can be retained in the completely-retaining position after the two connectors 10 and 20, held in the completely-fitted condition, are rotated a predetermined angle relative to the lock frame 30.

Therefore, by rotating the second connector 20 through more than the predetermined angle relative to the lock frame 30, the two connectors 10 and 20 can be completely fitted together regardless of molding errors and dimensional tolerances of the constituent parts.

In the connector assembly of the present invention, the configurations of the first and second cam grooves, formed in the lock frame, and the positions of formation thereof, and the configurations of the first and second engagement projections, formed on the first and second connectors, and the positions of formation thereof, are not limited to those in the above embodiment, and various forms can be adopted within the scope of the invention.

For example, with respect to the fitting force required for fitting the first and second connectors together, the force, required at an initial stage of the fitting operation before the contacts are brought into contact with each other, is different from the force required at a later stage of the fitting operation after the contacts are brought into contact with each other. Therefore, by suitably determining the configurations of the first and second cam grooves (curvatures of these grooves in the outer peripheral surface of the lock frame), the angle of rotation of the second connector and the stroke in the rotation fitting direction can be optimized so that the fitting force can be made generally constant.

In the connector assembly of the above embodiment, although the first and second cam grooves are formed in the lock frame in adjacent relation to each other, these cam grooves may be spaced a predetermined angle (phase) (for example, 90 degrees) from each other in the direction of the circumference of the lock frame.

In the above embodiment, although the first and second cam grooves 36 and 39, each having an open bottom, are formed through the peripheral wall of the lock frame 30, these grooves may be formed in the inner peripheral surface of the lock frame in such a manner that each of these grooves have a closed bottom.

As is clear from the foregoing description, in the connector assembly of the present invention and the mounting method of mounting this connector assembly, the operator is required merely to provisionally retain the first connector at the one open end of the lock frame and then to insert the second connector into the lock frame, fixed to the through hole, while rotating the second connector, and by doing so, the first and second connectors can be fitted together.

The forces to fit the first and second connectors together act respectively on the first and second connectors through the first and second engagement projections engaged respectively in the first and second cam grooves extending spirally along the axis of the lock frame, and therefore an eccentric force hardly acts on the two connectors during the time when the two connectors are fitted together.

Therefore, the two connectors are hardly twisted, and can be fitted together satisfactorily with the low operating force, and the two connectors can be positively connected together.

The mutually-fitted condition of the first and second connectors corresponds to the position of rotation of the second connector relative to the lock frame, and therefore in order to completely fit the two connectors together, the second connector must be rotated into a predetermined position relative to the lock frame.

Therefore, by observing the position of rotation of the second connector relative to the lock frame, a half-fitted condition of the first and second connectors can be quite easily detected.

Therefore, there can be provided the connector assembly and the connector assembly-mounting method, in which the two connectors can be fitted together with the low inserting force, and a half-fitted condition can be prevented, and the mounting operation can be effected easily.

What is claimed is:

1. A connector assembly comprising:

a cylindrical lock frame fixed to a through hole of a mounting panel by at least a locking arm thereon;

a first cam groove extending spirally along an axis of said lock frame in continuous relation to one open end of said lock frame;

a second cam groove extending spirally in the same direction as a direction of said first cam groove in continuous relation to the other open end of said lock frame;

a first connector fitted in the one open end of said lock frame, and having a first engagement projection engaged in said first cam groove, said first engagement projection engaged in a provisionally-retaining position of said first cam groove to provisionally retain said first connector at the one open end of said lock frame, a second connector fitted in the other open end of said lock frame, and having a second engagement projection engaged in said second cam groove, said second connector inserted into the other open end of said lock frame with said second engagement projection being engaged in said second cam groove so that said second connector is held in a provisionally-fitted condition relative to said first connector disposed in said provisionally-retaining position.

2. A connector assembly as claimed in claim 1, wherein said second engagement projection of said second connector is engaged with a notch of said first connector when said first and second connectors are inserted in said lock frame, and wherein said first and second cam grooves are arranged so that rotating said second connector causes said second engagement projection to follow said second cam groove and said first engagement projection to follow said first cam groove, which displaces said first connector from said provisionally-retaining position to a completely-retaining position, and also completely fits said first connector relative to said second connector.

3. A connector assembly according to claim 2, in which said first cam groove has a retaining projection for retaining said first engagement projection in said provisionally-retaining position.

4. A connector assembly according to claim 2, in which said first and second cam grooves are arranged so that when said first and second connectors are in a completely-fitted condition, said first and second connectors can be rotated a predetermined angle relative to said lock frame.

5. A connector assembly according to claim 4, in which said first cam groove has a retaining projection for retaining said first engagement projection in said provisionally-retaining position.

6. A connector assembly according to claim 1, wherein at least two pairs of said first and second cam grooves are disposed at equal intervals around the axis of said lock frame, and at least two pairs of said first and second engagement projections are disposed at equal intervals around the axes of said first and second connectors.

7. A connector assembly according to claim 6, in which said first cam groove has a retaining projection for retaining said first engagement projection in said provisionally-retaining position.

8. A connector assembly according to claim 6, in which said first and second cam grooves are arranged so that when said first and second connectors are in a completely-fitted condition, said first and second connectors can be rotated a predetermined angle relative to said lock frame.

9. A connector assembly according to claim 8, in which said first cam groove has a retaining projection for retaining said first engagement projection in said provisionally-retaining position.

10. A connector assembly according to claim 1, in which said first and second cam grooves are arranged so that when said first and second connectors are in a completely-fitted condition, said first and second connectors can be rotated a predetermined angle relative to said lock frame.

11. A connector assembly according to claim 10, in which said first cam groove has a retaining projection for retaining said first engagement projection in said provisionally-retaining position.

12. A connector assembly according to claim 1, in which said first cam groove has a retaining projection for retaining said first engagement projection in said provisionally-retaining position.

13. A connector assembly according to claim 1, wherein rotation of said second connector causes said first connector to rotate together with said second connector, and wherein said first and second cam grooves are arranged so that said first and second connectors rotatably move closer together.

14. A method of mounting a connector assembly including a generally cylindrical lock frame fixed to a through hole of a mounting panel by at least a locking arm thereon, a first cam groove extending spirally along an axis of said lock frame in continuous relation to one open end of said lock frame, a second cam groove extending spirally along an axis of said lock frame in continuous relation to one open end of said lock frame, a second cam groove extending spirally in the same direction as a direction of said first cam groove in continuous relation to the other open end of said lock frame, a first connector which is fitted in the one open end of said lock frame, and has a first engagement projection engaged in said first cam groove and a second connector which is fitted in the other open end of said lock frame, and has a second engagement projection engaged in said second cam groove, said method comprising the steps of:

engaging said first engagement projection in a provisionally-retaining position of said first cam groove to provisionally retain said first connector at the one open end of said lock frame, and subsequently fix said lock frame to said through hole;

inserting said second connector into the other open end of said lock frame to engage said second engagement projection in said second cam groove, so that said second connector is held in a provisionally-fitted condition relative to said first connector disposed in said provisionally-retaining position; and inserting said second connector into said lock frame while rotating said second connector, following said second cam groove, thereby displacing said first connector from said position while rotating said first connector, following said first cam groove, so that said first and second connectors are completely fitted together.

* * * * *